US005943972A

United States Patent [19]

Hirata

[11] Patent Number: 5,943,972

[45] Date of Patent: Aug. 31, 1999

[54] EMBROIDERY DATA PROCESSING APPARATUS

[75] Inventor: Takashi Hirata, Nagoya, Japan

[73] Assignee: Brother Kogyo Kabushiki Kaisha, Nagoya, Japan

[21] Appl. No.: 09/192,283

[22] Filed: Nov. 16, 1998

[30] Foreign Application Priority Data

Feb. 27, 1998 [JP] Japan ..... 10-64810

[51] Int. Cl.[6] ..... D05B 21/00; D05C 5/06

[52] U.S. Cl. ..... 112/102.5; 112/475.19; 364/470.09

[58] Field of Search ..... 112/102.5, 470.04, 112/470.06, 475.19; 364/470.09, 470.07

[56] References Cited

U.S. PATENT DOCUMENTS 5,537,945 7/1996 Sugihara et al. .

5,823,127 10/1998 Mizuno ..... 112/102.5

5,839,380 11/1998 Muto ..... 112/102.5

5,865,133 2/1999 Herbach et al. ..... 112/475.19

FOREIGN PATENT DOCUMENTS 7-250983 10/1995 Japan .

2653257 5/1997 Japan .

*Primary Examiner*—Peter Nerbun

*Attorney, Agent, or Firm*—Oliff & Berridge, PLC

[57] ABSTRACT

A sewing apparatus for sewing an embroidery pattern that is larger than an embroidery region of an embroidery frame. The sewing apparatus divides the embroidery pattern into embroidery regions and causes the embroidery regions to overlap a predetermined width including a boundary line between adjacent embroidery regions.

21 Claims, 13 Drawing Sheets

EMBROIDERY DATA PROCESSING APPARATUS

BACKGROUND OF THE INVENTION

1. Field of Invention

The present invention relates to a sewing apparatus, particularly to a technology in which when a single embroidery pattern or a plurality of embroidery patterns selected via a display are projected from one embroidery region, the region is divided into a plurality of embroidery regions and the sewing operation is carried out over plural times.

2. Description of Related Art

Conventionally, according to an electronic control type embroidery machine for household use as a sewing apparatus, an embroidery data memory installed to ROM (involatile memory) of a control device, is stored with pattern data of practically-used patterns of linear seam, zigzag seam and so on, letter patterns of Japanese syllabary and the like and a plurality of embroidery patterns of symbols, marks, various patterns and so on. While displaying these patterns on a display, searching a desired pattern by switching display screens and selecting a desired embroidery pattern, a selected embroidery pattern can simply be sewn by only operating a sewing start switch.

When, for example, a name of a child is sewn by embroidery sewing on a cloth bag by using an embroidery machine, where a number of letters is large and an embroidery frame mounted to the embroidery machine is small, several letters at the end of the name may be outside of an embroidery region of the embroidery frame. In this case, an error message may be displayed and letters outside of the embroidery region may not be inputted. Accordingly, sewing operation is carried out by inputting only a row of letters which can be sewn in the embroidery region as a first step, cloth for fabrication is restretched to the embroidery frame and thereafter, sewing operation is carried out after inputting the remaining letter row.

In the case of inputting letters of a name, no problem is posed when all of a letter row can be inputted because the letter size is small and sewing can be carried out in one operation. However, when letters are projected from an embroidery region by enlarging the size of letters in an editing operation, similar to the above-described, sewing operation is carried out by inputting several letters which can be sewn as a first step, restretching the cloth to an embroidery frame and then inputting and sewing the remaining letter row.

In this case, for reference, the applicant has proposed a technology in Japanese Patent Publication No. 2653257 in which, for example, when a name of a baseball team is embroidered over left and right front portions of a uniform, in the case where a letter is divided at a position where the left and right front portions overlap, the letter is previously divided and embroidery data is formed for the respective front portions.

As has been described above, when all of a plurality of patterns to be sewn cannot be inputted in one operation due to a size of sewing and a size of an embroidery frame, several patterns are partially and selectively set at respective operations of sewing. In that case, patterns for sewing are selectively set one by one after displaying them on a pattern selecting screen at respective operations of selecting patterns, which are devoid of operational performance. When the respective operations of sewing are carried out at a second and subsequent times, by restretching cloth for fabrication, it is very difficult to set the cloth for fabrication such that a pattern sewn at a preceding time beautifully continues to a pattern of a current time. That is, it is difficult to ensure that a portion of an embroidery region at the preceding time is made to overlap an embroidery region at the current time and therefore, the operational efficiency of sewing operation is deteriorated.

SUMMARY OF THE INVENTION

It is an object of the present invention to be able to simplify selecting an embroidery pattern present over a plurality of embroidery regions by restretching cloth for fabrication and achieving increased sewing operation efficiency. While the invention is described using the example of a singular sewing apparatus, the invention also applies to multiple ganged sewing machines connected to a central data source.

According to a first aspect of the present invention, there is provided a sewing apparatus capable of sewing an embroidery pattern on a cloth by independently moving an embroidery frame set with the cloth in two directions orthogonal to each other. The sewing apparatus includes a pattern selector for selectively setting a single embroidery pattern or a plurality of embroidery patterns for an embroidery operation and a determiner for determining whether the selectively set embroidery patterns project from an embroidery region of the embroidery frame and intersect with a boundary line between the embroidery region and an embroidery region contiguous thereto. The determination is based on information of arrangements and sizes of the embroidery patterns selectively set by the pattern selector and information of a size of the embroidery frame. The sewing apparatus also includes a pattern divider for receiving pattern data of the single or the plurality of embroidery patterns selected by the pattern selector, dividing the embroidery patterns intersecting with the boundary line and forming pattern data for respective divided embroidery regions when the determiner determines that the embroidery pattern intersects with the boundary. When the single or the plurality of embroidery patterns for the embroidery operation are selectively set by the pattern selector, the determiner determines whether the selectively set embroidery pattern is projected from the embroidery region of the embroidery frame and intersects with the boundary line between the embroidery region and another embroidery region contiguous thereto. This determination is based on the information of the arrangement and the size of the single or the plurality of embroidery patterns selectively set by the selector and the information of the size of the embroidery frame for sewing. Further, the pattern divider receives the pattern data of the single or the plurality of embroidery patterns selected by the pattern selector, divides the intersected embroidery pattern and forms the pattern data for the respective divided embroidery regions when the determiner determines that the embroidery pattern intersects with the boundary line. That is, the single or the plurality of embroidery patterns sewing the cloth over the plurality of embroidery regions can selectively be set in one motion and by only restretching the cloth for fabrication at each time of finishing the embroidery sewing of the divided embroidery region, the divided embroidery patterns selectively set can successively be sewn. According to the present invention, there are provided the pattern selector, the determiner and the pattern divider. Therefore, the single or the plurality of embroidery patterns for sewing the cloth over the plurality of embroidery regions can be selectively set in one motion, the cloth for fabrication is only restretched at each time of finishing the embroidery sewing of the divided embroidery region, the selectively set embroidery pattern can be sewn easily and efficiently and operational performance and sewing operation efficiency can be improved.

Further, according to another aspect of the present invention, there is provided a sewing apparatus wherein the embroidery regions are set as regions inside of an outer peripheral line of a sewable region in the embroidery frame by predetermined small distances. The pattern divider divides the embroidery pattern such that a divided embroidery pattern on one side of the boundary and a divided embroidery pattern on other side of the boundary overlap by a predetermined width including the boundary line. In this case, in dividing the selectively set embroidery pattern, the divided embroidery pattern on one side of the boundary line and the divided embroidery pattern on the other side of the boundary are produced to be slightly larger such that they overlap each other by the predetermined width including the boundary line. The divided embroidery pattern on one side and the divided embroidery pattern on the other side are sewn in the respective embroidery regions. Overlap portions of the one side and the other side are respectively sewn continuous to outer sides of the embroidery regions and the overall embroidery pattern at the boundary line is made continuous with no interruption by the overlap portions. According to the present invention, the embroidery regions are set as regions inside of an outer peripheral line of a sewable region in the embroidery frame by predetermined small distances. In dividing the embroidery pattern, the embroidery divider divides the embroidery pattern such that the divided embroidery pattern on one side of the boundary and the divided embroidery pattern on the other side of the boundary overlap each other by the predetermined width including the boundary line. Accordingly, the divided embroidery pattern on one side of the boundary and the divided embroidery pattern on the other side of the boundary are sewn in the embroidery region. The overlap portions on one side and the other side thereof are respectively sewn continuously on the outer sides of the embroidery regions and the overall embroidery pattern at the boundary line can be sewn beautifully and continuously with no interruption.

Further, according to another aspect of the present invention, there is provided a sewing apparatus wherein the pattern divider includes a data adder for adding mark data for sewing a plurality of reference marks constituting a longitudinal direction reference and a lateral direction reference as marks for use in restretching the cloth to the embroidery frame. According to the present invention, mark data for the reference marks are added to the divided embroidery patterns by the data adder. Accordingly, in restretching the cloth to the embroidery frame after finishing sewing one embroidery region and sewing the successive new embroidery region, the reference marks can constitute the longitudinal and lateral direction references and restretching the cloth is simplified.

According to another aspect of the present invention, there is provided a sewing apparatus further including a display and display controller for controlling the display wherein a necessary size of the cloth is displayed on the display. This size is based on the arrangement and the size of the selected embroidery pattern, the size of the embroidery frame and a number of the boundary lines dividing the embroidery pattern. According to the present invention, there are provided the display and the display controller for controlling the display. In the sewing operation, the necessary size of the cloth is displayed on the display. This size is based on the arrangement and the size of the single or the plurality of embroidery patterns selectively set, the size of the embroidery frame and the number of the boundary lines for dividing the embroidery pattern. Accordingly, a minimum necessary size of the cloth for sewing the single or the plurality of selected embroidery patterns can easily be recognized via the display.

Further, according to another aspect of the present invention, there is provided a sewing apparatus wherein when the selected embroidery pattern is present over a plurality of the embroidery regions, the embroidery pattern, the plurality of embroidery regions and the boundary lines are displayed on the display. According the present invention, when the selected embroidery pattern is present over a plurality of embroidery regions, the embroidery pattern and the plurality of embroidery regions and the boundary line are displayed on the display. Accordingly, in sewing the single or the plurality of selected embroidery patterns, a number of divisions and a number of times of restretching the cloth can easily be recognized via the display.

Further, according to another aspect of the present invention, there is provided a sewing apparatus further including an embroidery frame determiner capable of selectively using a plurality of embroidery frames having different sizes for the embroidery frame. The embroidery frame determiner determines the embroidery frame suitable for use based on the pattern data of the embroidery patterns selectively set by the pattern selector. According to the present invention, there is provided the embroidery frame determiner capable of selectively using a plurality of embroidery frames having different sizes as the embroidery frame. The embroidery frame determiner determines an embroidery frame suitable for use based on the pattern data of the embroidery pattern selectively set by the pattern selector. Accordingly, in sewing the single or the plurality of selected embroidery patterns, which embroidery frame is to be used can easily be recognized via the display.

Further, according to another aspect of the present invention, there is provided a sewing apparatus wherein frame side reference marks in correspondence with the plurality of reference marks are inscribed on the embroidery frame. According to the present invention, the frame side reference marks in correspondence with the plurality of reference marks are inscribed on the embroidery frame. Therefore, in restretching the cloth, by only making the sewn reference marks to coincide with the frame side reference marks, the longitudinal and lateral direction references in sewing a successive embroidery region can be determined with excellent accuracy, accuracy of positioning in restretching the cloth for fabrication can be promoted and restretching of the cloth is simplified.

BRIEF DESCRIPTION OF THE DRAWINGS

A preferred embodiment of the present invention will be described in detail with reference to the following figures where like reference numerals represent like elements, and wherein.

DETAILED DESCRIPTION OF PREFERRED EMBODIMENTS

An explanation will be given of an embodiment of the present invention in reference to drawings as follows.

Figure 1:
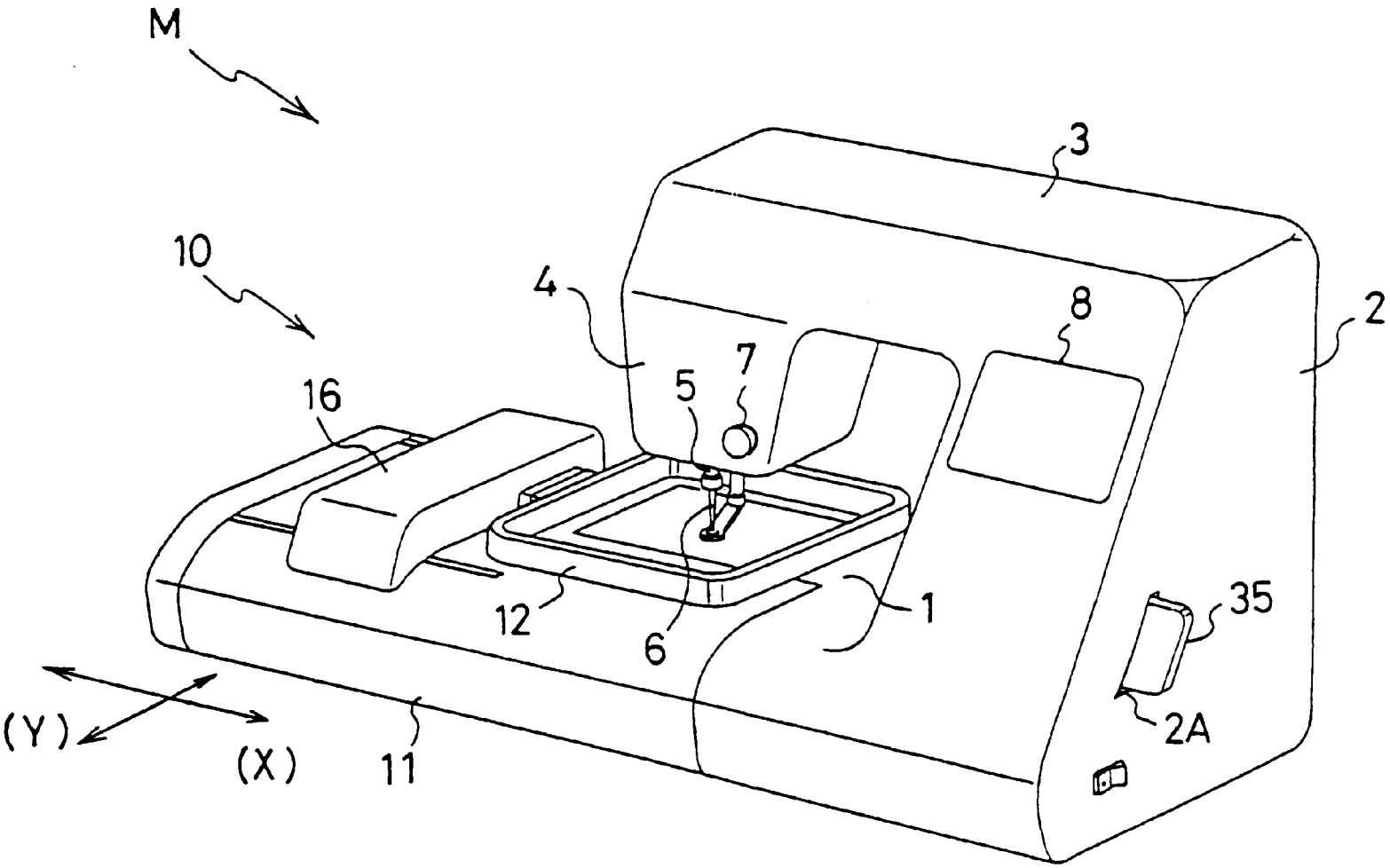
FIG. 1 is a front view of an electronic control type embroidery machine according to an embodiment of the present invention.

FIG. 1 shows an example of the present invention applied to an electronic control type embroidery machine capable of sewing various embroidery patterns.

As shown in FIG. 1, an electronic control type embroidery machine M is provided with a bed portion 1, a pedestal portion 2 erected from a right end portion of the bed portion 1 and an arm portion 3 extended from an upper end of the pedestal portion 2 to be opposed to the bed portion 1.

The bed portion 1 is installed with a feed dog vertical moving mechanism (not illustrated) for moving a feed dog in the up and down direction and a feed dog horizontal moving mechanism (not illustrated) for moving the feed dog in the forward and rearward direction. The bed portion 1 also has a thread ring catcher (for example, horizontal rotating shuttle) containing a lower thread bobbin and moving in cooperation with a sewing needle 6. The pedestal portion 2 is formed with a card slot 2A for connecting, for example, a ROM card 35 recorded with recording pattern data (pattern display data, sewing data and appended information) for a number of embroidery patterns to a card connector 27 (refer to FIG. 3) inside of the machine.

The arm portion 3 has at least a needle rod driving mechanism for moving a needle rod 5 mounted with the sewing needle 6 at its lower end in the up and down direction, a needle rod rocking mechanism (not illustrated) for rocking the needle rod 5 in a direction orthogonal to a cloth feed direction, a needle thread take-up driving mechanism (not illustrated) for moving a needle thread take-up in the up and down direction in conformity with movement of the needle rod 5 in the up and down direction.

The feed dog vertical moving mechanism, the needle rod driving mechanism and the needle thread take-up driving mechanism are driven by a machine motor 31. The needle rod rocking mechanism is driven by a stepping motor 32 for rocking the needle rod and the feed dog horizontal moving mechanism is driven by a stepping motor 33 for driving the feed dog (refer to FIG. 3).

A head portion 4 of the arm portion 3 has a start/stop switch 7 for starting and stopping the sewing operation.

A large-sized liquid crystal display 8 is, for example, provided on a front face of the arm portion 3 and the liquid crystal display 8 displays, for example, various seam patterns of practically-used patterns, embroidery patterns and the like and various messages. The front face of the liquid crystal display 8 is installed with, for example, a touch panel 9 provided with transparent electrodes in a strip-like shape respectively in the vertical direction and in the horizontal direction in correspondence with respectives of display positions of a plurality of embroidery patterns and function names showing functions and functioning as touch keys. That is, selection of a desired embroidery pattern or function can be realized by pressing the touch keys 9 in correspondence with the embroidery patterns and the function names.

A left end side portion of the bed portion 1 is formed with a free bed portion referred to as a free arm and a frame driving mechanism 10 is detachably mounted to the free bed portion.

The frame driving mechanism 10 is provided with a main body case 11, an embroidery frame 12 for detachably mounting cloth for fabrication, a containing case 16 containing a Y-direction driving mechanism for driving the embroidery frame 12 in a Y-direction (forward and rearward direction) and an X-direction driving mechanism contained in the main body case 11 for driving the containing case 16 and the Y-direction driving mechanism at inside thereof in an X-direction (left and right direction). The X-direction driving mechanism is driven by an X drive motor 17 and the Y-direction driving mechanism is driven by a Y drive motor 18 (refer to FIG. 3).

When the embroidery device 10 is mounted to the free bed portion, both drive motors 17 and 18 are electrically connected to a control device 20 of the embroidery machine M and the state of mounting the frame driving mechanism 10 is detected. The control device 20 drives motors 17 and 18 to bring the embroidery frame 12 and cloth into a state where embroidery sewing can be carried out while moving them in the X-direction and the Y-direction independently from each other.

Figure 2:
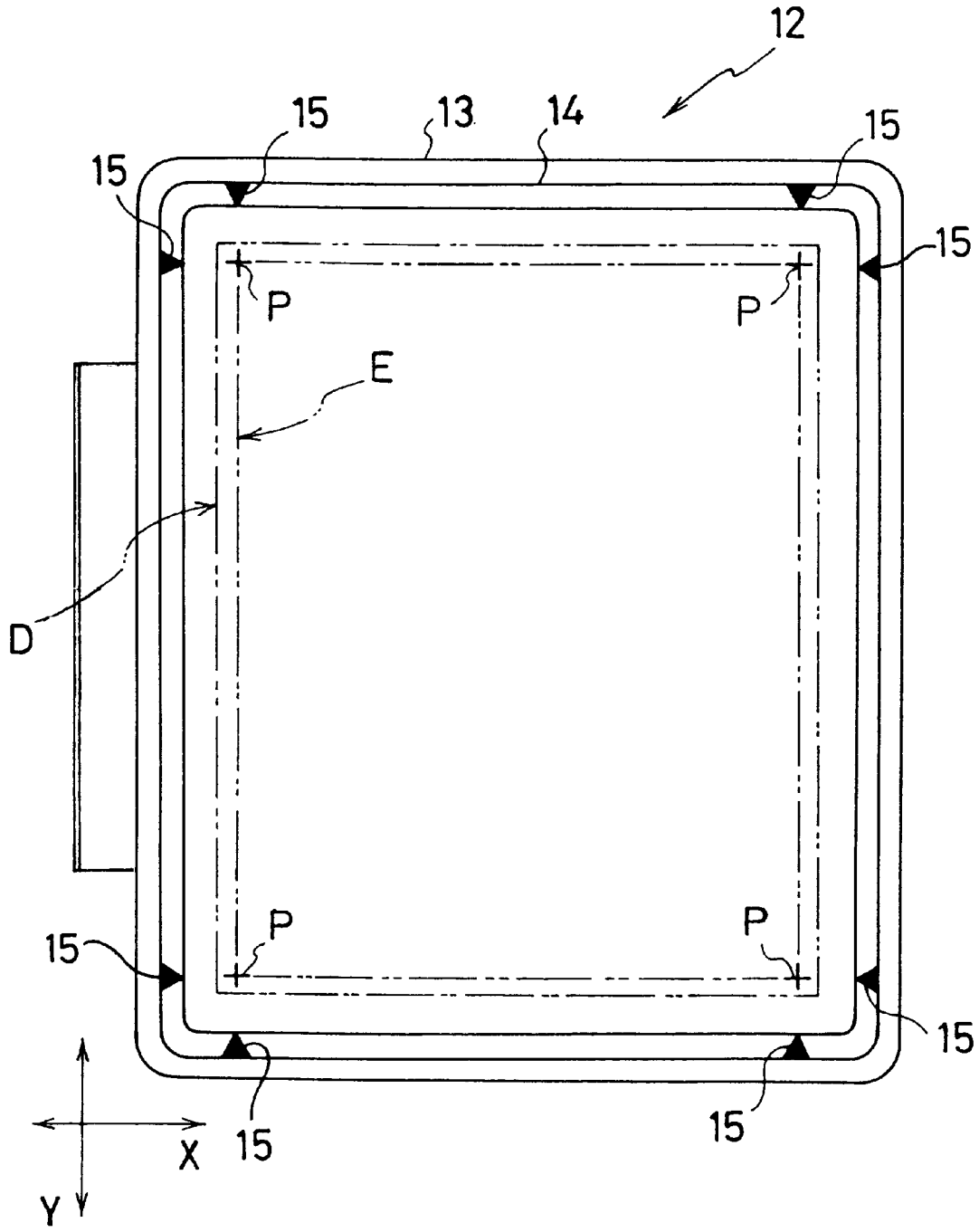
FIG. 2 is a plane view of an embroidery frame.

Meanwhile, as shown by FIG. 2, the embroidery frame 12 is constituted by an outer frame 13 and an inner frame 14. On the inner side of the inner frame 14, as shown by two-dotted chain lines, a sewable region D in a rectangular shape in which the sewing needle 6 can be moved is defined. An embroidery region E is set as a rectangular region inside of outer peripheral lines (two-dotted chain lines) of the sewable region D by a predetermined small distance.

Further, the inner frame 14 is inscribed with, for example, eight frame side reference marks 15 (in a triangular shape) in correspondence with a longitudinal direction reference position and a lateral direction reference position prescribing the embroidery region E in a rectangular shape. That is, as mentioned later, the frame side reference marks 15 correspond with reference marks P (in a cross shape) which are sewn at each sewing operation of the respective embroidery region E for sewing a succeeding one of the embroidery region E when the succeeding one of the embroidery region E is sewn by restretching the cloth. Meanwhile, in respect of the embroidery frame 12, a large frame, a middle frame and a small frame are prepared depending on the size of the embroidery region E. A width of the embroidery region E of each embroidery frame 12 is previously stored in ROM 23 of the control device 20.

Next, an explanation will be given of a control system of the embroidery machine M.

Figure 3:
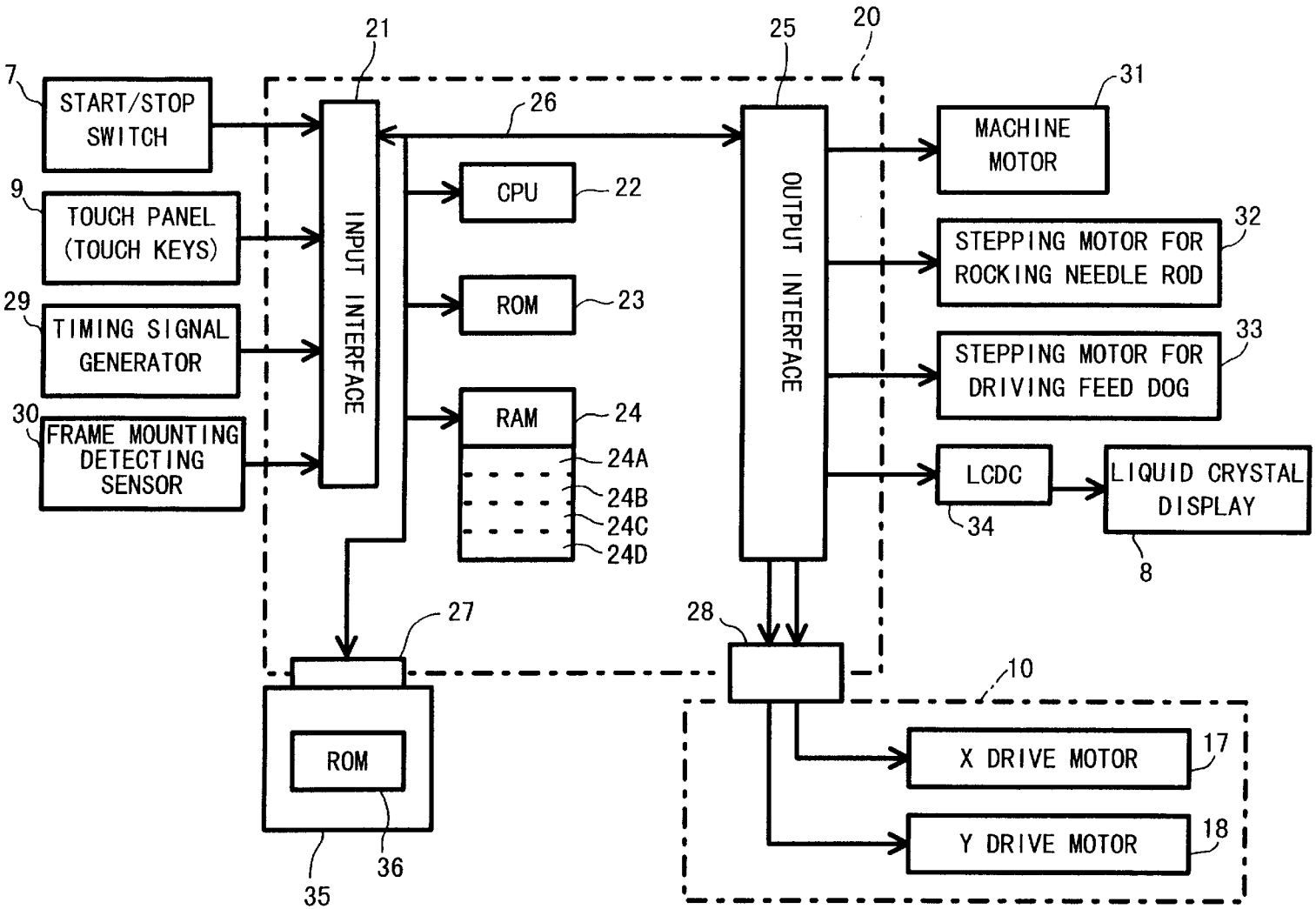
FIG. 3 is a block diagram of a control system of the electronic control type embroidery machine.

As shown by FIG. 3, the control device 20 is provided with an input interface 21, a control unit including CPU 22, ROM 23 and RAM 24, an output interface 25 and a bus 26 connecting these. The input interface 21 is respectively connected with the start/stop switch 7, the touch panel (touch keys) 9, a timing signal generator 29 for detecting a plurality of rotational phases of a machine main spindle and a frame mounting detecting sensor 30 for detecting mounting of the embroidery frame 12.

The output interface 25 is connected with at least the machine motor 31, the stepping motor 32 for rocking the needle bar, the stepping motor 33 for driving the feed dog, a display controller (LCDC) 34 for displaying the liquid crystal display 8, a connector 28 connected to the X drive motor 14 and the Y drive motor 15 of the frame driving device 10. ROM 36 of the ROM card 35 is connected to the bus 26 via the card connector 27.

ROM 23 stores at least a control program of pattern selecting control for selecting practically-used patterns or various embroidery patterns, general control programs of drive control for driving the respective motors 31 through 33, 17 and 18 for sewing a selected embroidery pattern and display control, a control program of an editing processing for carrying out an editing processing of setting a size, changing a sewing position or the like in respect of the selected embroidery pattern via the display 8, and a control program of pattern sewing control which will be mentioned later as a feature of the present application. Further, ROM 23 is stored with pattern data having display data and embroidery data with regard to respectives of pluralities of practically-used patterns and practically-used data patterns and various embroidery patterns classified in groups in accordance with kinds of patterns and attached with pattern numbers.

A plurality of sheets of the ROM cards 35 are prepared in accordance with kinds of embroidery patterns. ROM 36 of ROM cards 35 is recorded with pattern data of a number of embroidery patterns (first embroidery pattern, second embroidery pattern, third embroidery pattern . . . ) and pattern width data thereof for each pattern group of special various diagrams or configurations, marks, characters (for example, famous persons, animals, robots and so on appeared in TV programs, movies or the like). These pattern groups are in addition to general pattern groups of "animal", "vehicle", "flower" and so on having comparatively high frequencies of use by being classified in groups in accordance with kinds of patterns and attached with pattern numbers.

In this case, although not illustrated, when embroidery patterns are constituted by a plurality of colors (white, red, black, . . . ), pattern display data is provided with display data of color-classified pattern units in accordance with numbers of colors. Sewing data is provided with sewing data for the respective color-classified pattern units and stop codes for switching color. In this case, the pattern display data is stored as bit map data (dot image data).

RAM 24 is installed with a pattern memory 24A for storing pattern codes of selectively set patterns, a total pattern width memory 24B for storing data of a total pattern width of a plurality of selected patterns, a division number memory 24C for storing a number of divisions divided by boundary lines, a division embroidery pattern memory 24D for storing embroidery data of divided division embroidery patterns and memories (memories of flag, pointer, counter and the like, register, buffer and the like) necessary for various controls mentioned above.

Figure 4:
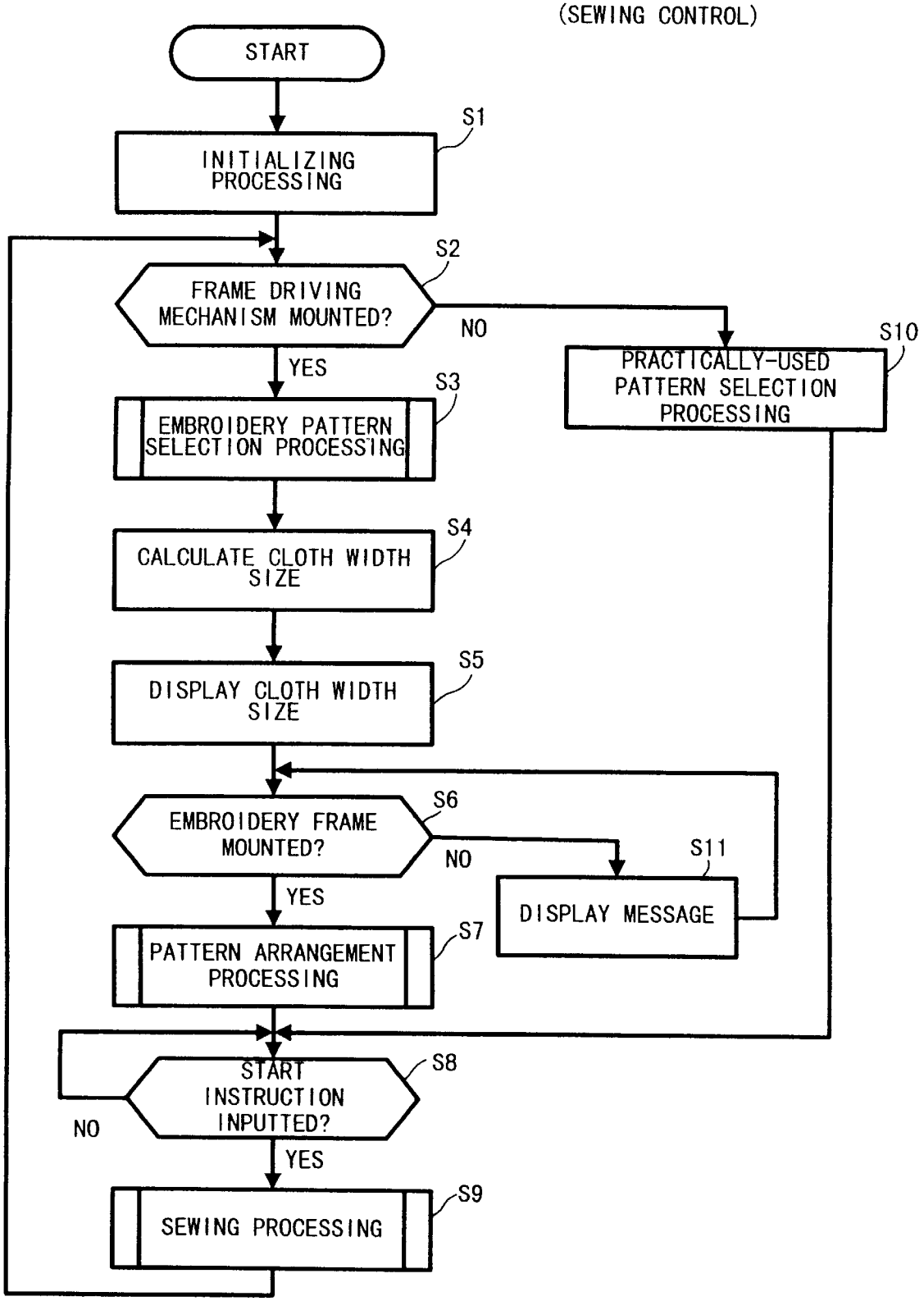
FIG. 4 is an outline flowchart of a routine of sewing control.

Next, an explanation will be given of a routine of sewing control executed by the control device 20 in reference to a flowchart of FIG. 4. Further, notations Si (i=1, 2, 3 . . . ) in the drawing designate respective steps.

When control is started by switching on a power source, an initializing processing of clearing the respective memories of RAM 24 or the like is executed (S1) When the frame driving mechanism 10 is not mounted (S2: No), a practically-used patterns selection processing for selecting practically-used patterns of zigzag, straight line or the like other than embroidery patterns is executed (S10).

Figure 7:
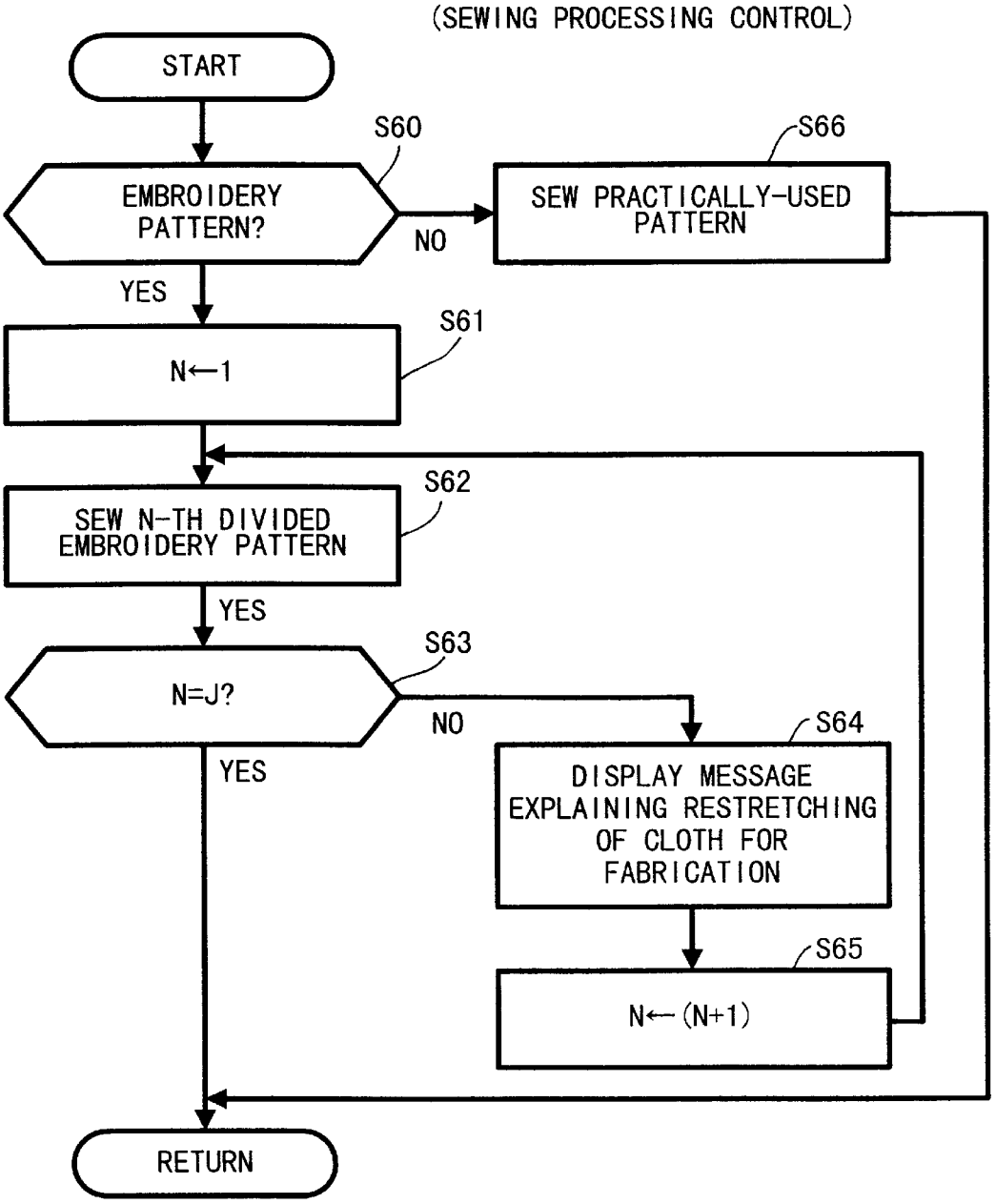
FIG. 7 is an outline flowchart of a routine of sewing processing control.

Further, when a start instruction is inputted from the start/stop switch 7 (S8: Yes), sewing processing control (refer to FIG. 7) is executed (S9). According to the sewing processing control, in the case of a practically-used pattern (S60: No), the practically-used pattern is sewn based on sewing data of the selected practically-used pattern (S66), the control is finished and the operation returns to sewing control.

Figure 5:
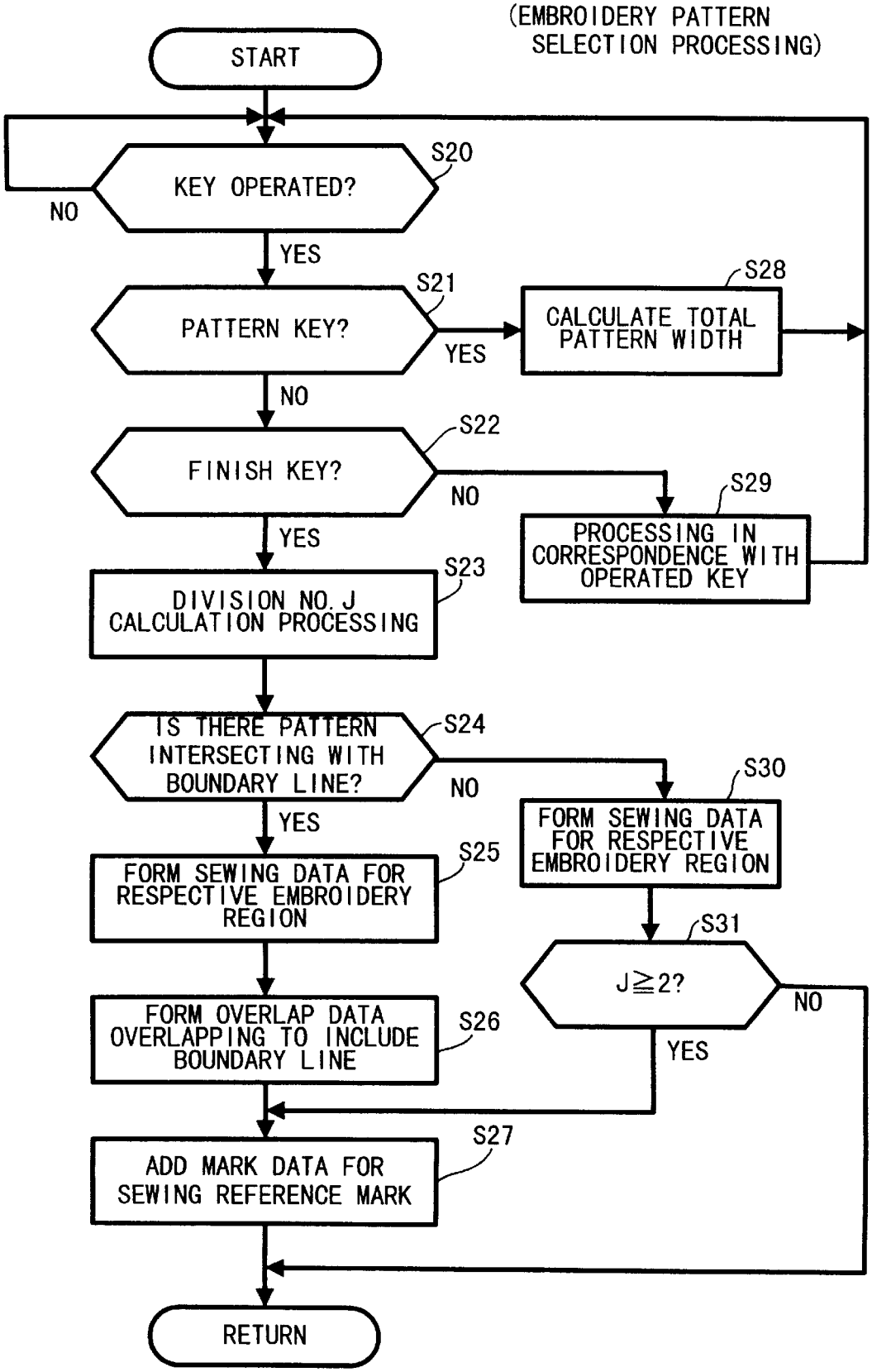
FIG. 5 is an outline flowchart of embroidery pattern selection processing control.

Meanwhile, when the frame driving mechanism 10 is mounted (S2: Yes), an embroidery pattern selection processing (refer to FIG. 5) for selecting various embroidery patterns other than practically-used patterns is executed (S3). In this case, according to the embroidery pattern selection processing, as the area of sewing operation increases due to an increase in a number of selected patterns, the embroidery region E becomes larger by successively switching from a small frame to a middle frame and a large frame.

Figure 13:
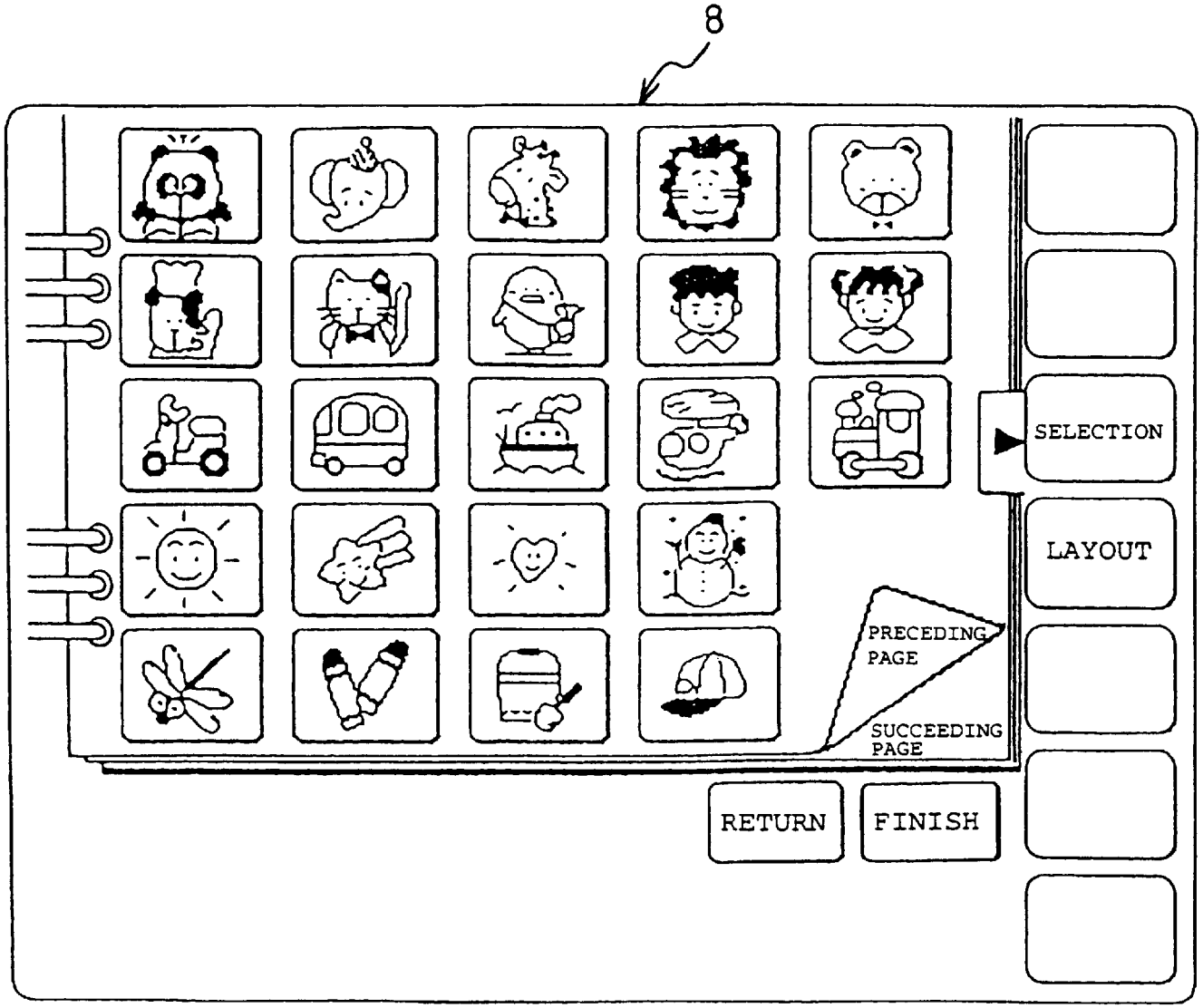
FIG. 13 is a diagram showing a display example of a plurality of embroidery patterns.

When the control is started, as shown by FIG. 13, a plurality of embroidery patterns are displayed on the display 8 in a table, function names of "succeeding page", "preceding page", "finish" and so on are displayed and by operating the key 9 in correspondence with "succeeding page" or "preceding page" (S20: Yes, S21, S22: No), as a processing in correspondence with the operated key, a plurality of embroidery patterns in correspondence with the succeeding page or the preceding page are switched and displayed (S29). When a desired embroidery pattern is displayed, in the case where the pattern key 9 in correspondence with the embroidery pattern is operated (S20, S21: Yes), the pattern code is stored to the pattern memory 24A of RAM 24 and data of the pattern width of the embroidery pattern is addingly calculated and stored to the total pattern width memory 24B as the total pattern width (S28).

Figure 8:
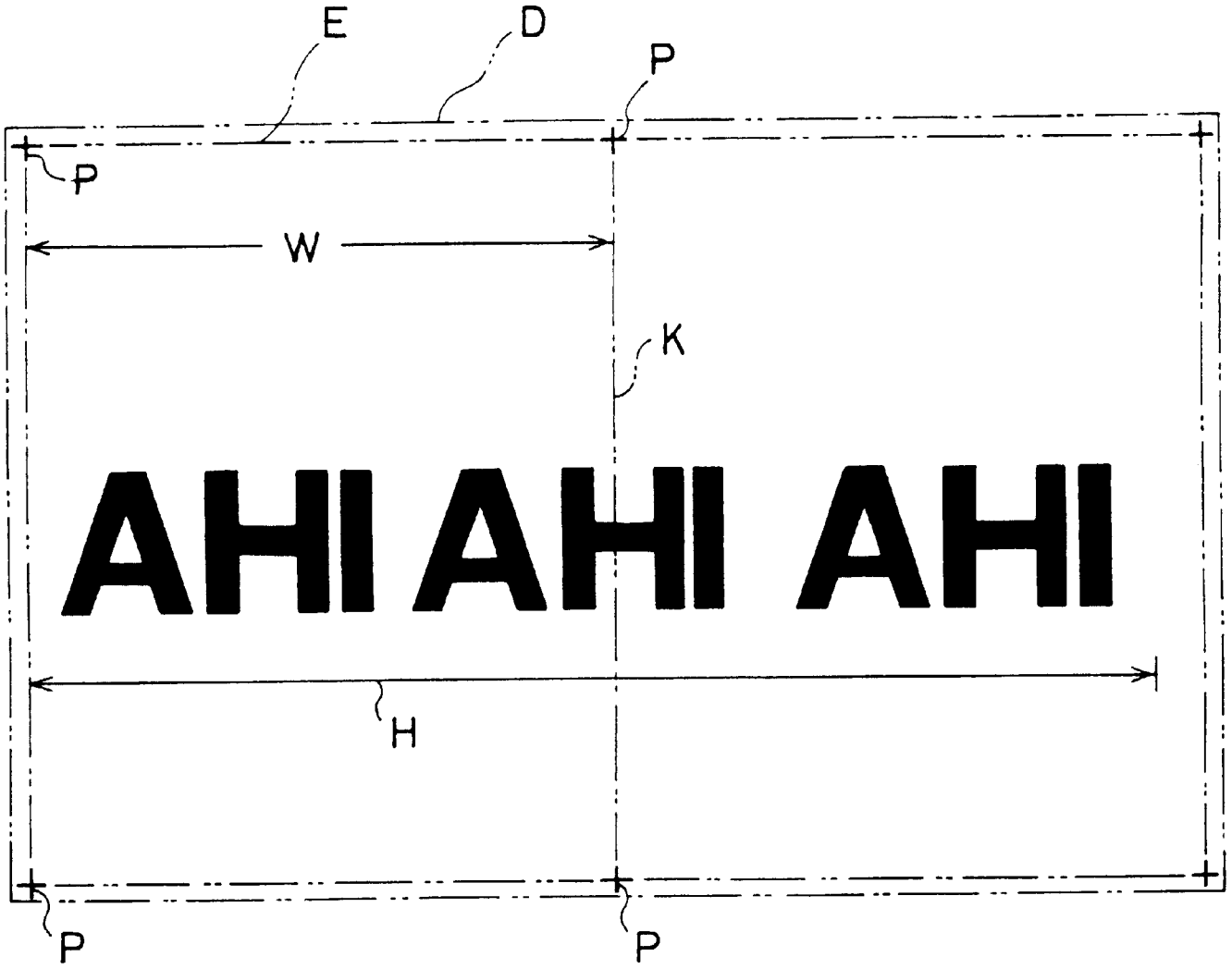
FIG. 8 is an explanatory view of a plurality of selected letter patterns and a boundary line dividing embroidery regions.

For example, as shown by FIG. 8, when data patterns "AHI AHI AHI" are selectively set, a pattern code of the plurality of letter patterns is stored to the pattern memory 24A and total pattern width data H is stored to the total pattern width memory 24B.

Next, when the finish key 9 is operated (S20: Yes, S21: No, S22: Yes), a number of divisions J divided by boundary lines K is calculated (S23). That is, as shown by FIG. 8, when the total pattern width data H is larger than a width size W of the embroidery region E of the large frame (which is the largest), the division number "2" is calculated by dividing the selected pattern by the boundary line K at each width size W. In this case, the letter pattern "H" intersects with the boundary line K.

Next, when the embroidery pattern intersects with the boundary line K (S24: Yes), embroidery data for respective ones of the embroidery region E divided by the respective boundary line K are formed and stored to the division embroidery pattern memory 24D (S25). Further, overlap data overlapping each other including the boundary line K are formed and addingly stored to the division embroidery pattern memory 24D (S26), mark data for sewing the reference marks P in a cross shape at positions in correspondence with corners of the embroidery region E are added to the division embroidery pattern memory 24D (S27), the control is finished and the operation returns to the sewing control.

Figure 9:
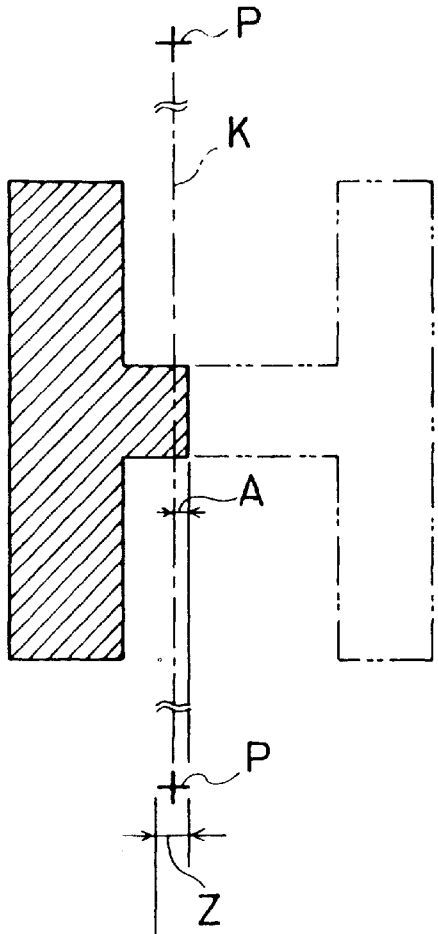
FIG. 9(A) is an explanatory view for explaining pattern division on the left side of a boundary line.
FIG. 9(B) is an explanatory view for explaining pattern division on the right side of the boundary line.
Figure 9:
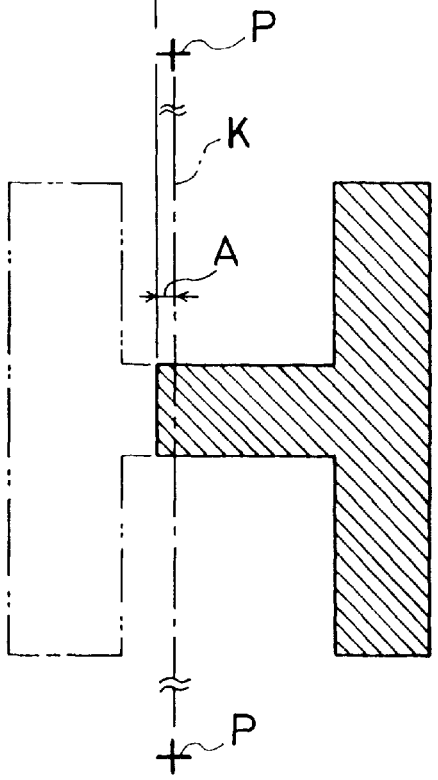

For example, as shown by FIG. 9(A), according to the letter pattern "H" intersecting with the boundary line K, the division embroidery pattern on the left side of the boundary line K is divided to be slightly larger such that the division embroidery pattern is extended to the right side from the boundary line K by a predetermined small width A to overlap by including the boundary line K.

Further, as shown by FIG. 9(B) the division pattern on the right side of the boundary line K is similarly divided to be slightly larger such that the division pattern is extended from the boundary line K to the left side by the predetermined small width A.

Further, as shown by FIG. 8, mark data for sewing reference marks P are formed at positions in correspondence with four corners of the embroidery region E to designate a longitudinal direction reference position and a lateral direction reference position of the embroidery region E. That is, the letter mark "H" is sewn by positioning the division pattern on the left side and the division pattern on the right side so that they overlap each other by a predetermined width Z including the boundary line K.

When the boundary line K does not intersect with the embroidery pattern (S24: No), sewing data are respectively formed for embroidery regions (S30). When the division number J is "2" or more (S31: YES), the mark data is added (S27), however, if the division number J is "1", (S31: NO) the control is immediately finished and the operation returns.

Figure 10:
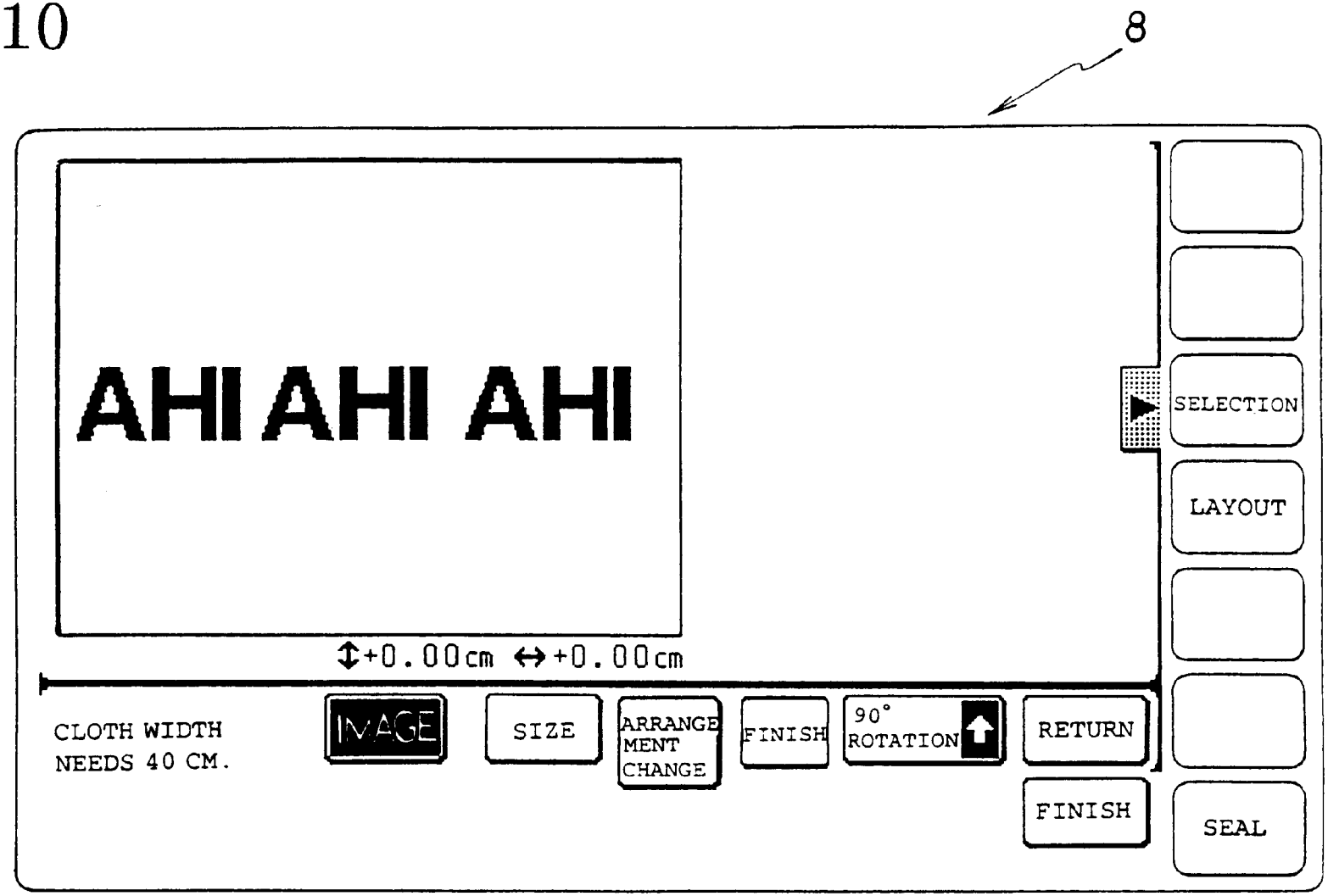
FIG. 10 is a view of a display example of a display screen displaying a plurality of selected letter patterns.

Further, in the sewing control, a cloth width size is calculated (S4) and the width size is displayed on the display 8 (S5). That is, a cloth width at a lowest limit necessary for sewing is produced by multiplying the width size W of the embroidery region E of the largest frame by the division number J and adding a predetermined width necessary for holding the cloth at the embroidery frame 12. This lowest limit of cloth width is displayed on a pattern displaying screen displaying a selectively set pattern as shown by, for example, FIG. 10 in a form of a message "Cloth width needs 40 cm".

When the embroidery frame 12 is not mounted based on a detection signal from the frame mounting detecting sensor 30 (S6: No), a message urging the user to mount the embroidery frame 12 is displayed (S11).

Figure 6:
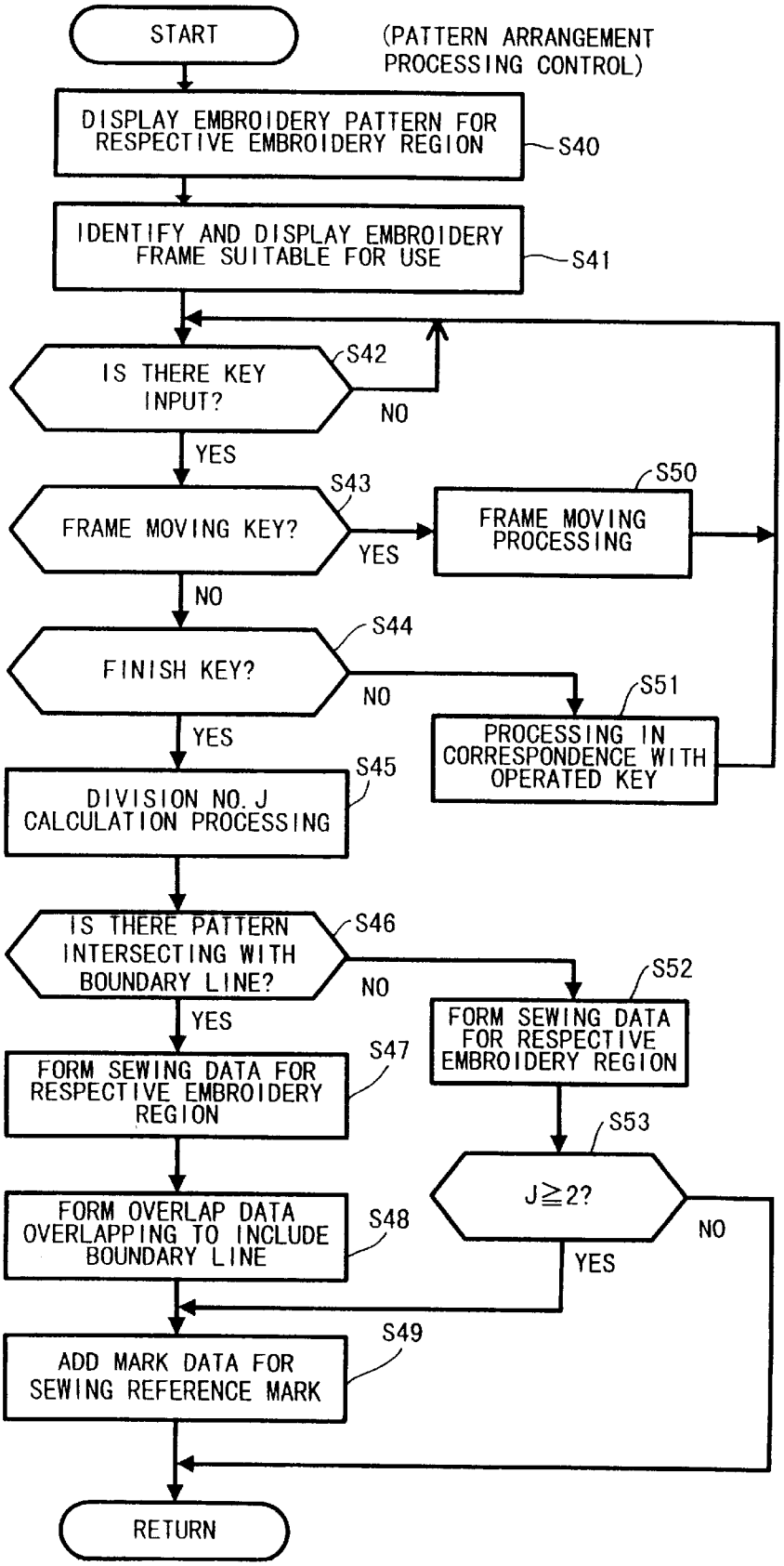
FIG. 6 is an outline flowchart of a routine of pattern arrangement processing control.

When the embroidery frame 12 is mounted (S6: Yes), pattern arrangement processing control, that is, edition processing control (refer to FIG. 6) is executed (S7).

Figure 11:
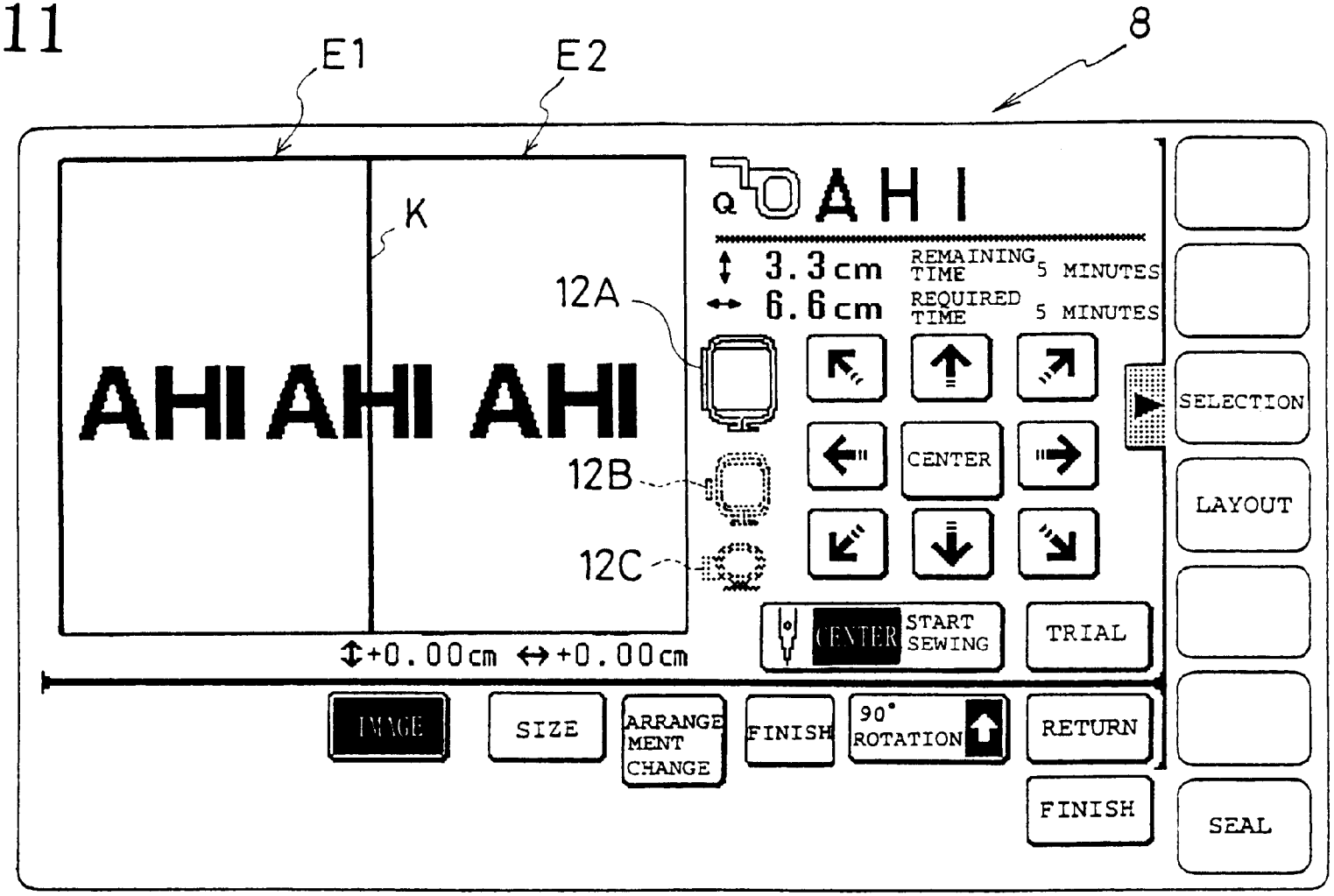
FIG. 11 is a view of the display example in an editing screen.

When the control is started, embroidery patterns for respective embroidery regions are displayed on the display 8 (S40) and an embroidery frame suitable for sewing the embroidery pattern is determined and displayed (S41). For example, as shown by FIG. 11, selected letter patterns "AHI AHI AHI" are displayed by two embroidery regions E1 and E2 with the boundary line K at the dividing position and a plurality of function keys including eight arrow mark keys for editing are displayed.

Further, on the basis of the total pattern width data H of the letter patterns "AHI AHI AHI" for sewing, the middle frame 12B and the small frame 12C are displayed by broken lines, however, only the large frame 12A is identified and displayed by bold lines and accordingly, it can be easily recognized that the large frame 12A is suitable for use.

Further, when the frame moving keys comprising the arrow mark keys are operated (S42•S43: Yes), a frame moving processing for moving the embroidery frame in the display screen, that is, a moving processing for moving the embroidery pattern relative to the embroidery region E is executed (S50).

Further, when a function key other than the frame moving key or the finish key is operated (S42: Yes, S43 through S44: No), various processings in correspondence with the operated function keys are executed (S51). When the finish key is operated (S42: Yes, S43: No, S44: Yes), similar to steps S23 through S27, the division number J is calculated (S45). When the embroidery pattern intersects with the boundary line K (S46: Yes), the embroidery data for respective embroidery regions E are formed (S47), overlap data is formed (S48), mark data is added (S49), the control is finished and the operation returns to the sewing control.

Further, when the embroidery pattern does not intersects with the boundary line K (S46: No), steps S52 through S53 and step S49 are executed similarly to steps S30 through S31 and step S27.

Further, when a start instruction is inputted by operating the start/stop switch 7 in the sewing control (S8: Yes), the sewing processing control (refer to FIG. 7) is executed (S9). According to the sewing processing control, in the case of the embroidery pattern (S60: Yes), an initial value "1" is set to a count value N of a counter for counting the embroidery regions to be sewn (S61), sewing data of an N-th division embroidery pattern is read and embroidery sewing is carried out based on sewing data (S62).

Next, when the count value N does not reach the division number J (S63: No), a message for explaining restretching of the cloth is displayed on the display 8 (S64), the count value N is incremented by one (S65) and steps S62 through S65 are repeatedly executed. When a final one of the embroidery regions E is sewn (S63: Yes), the control is finished and the operation returns to step S2 of the sewing control.

Figure 12:
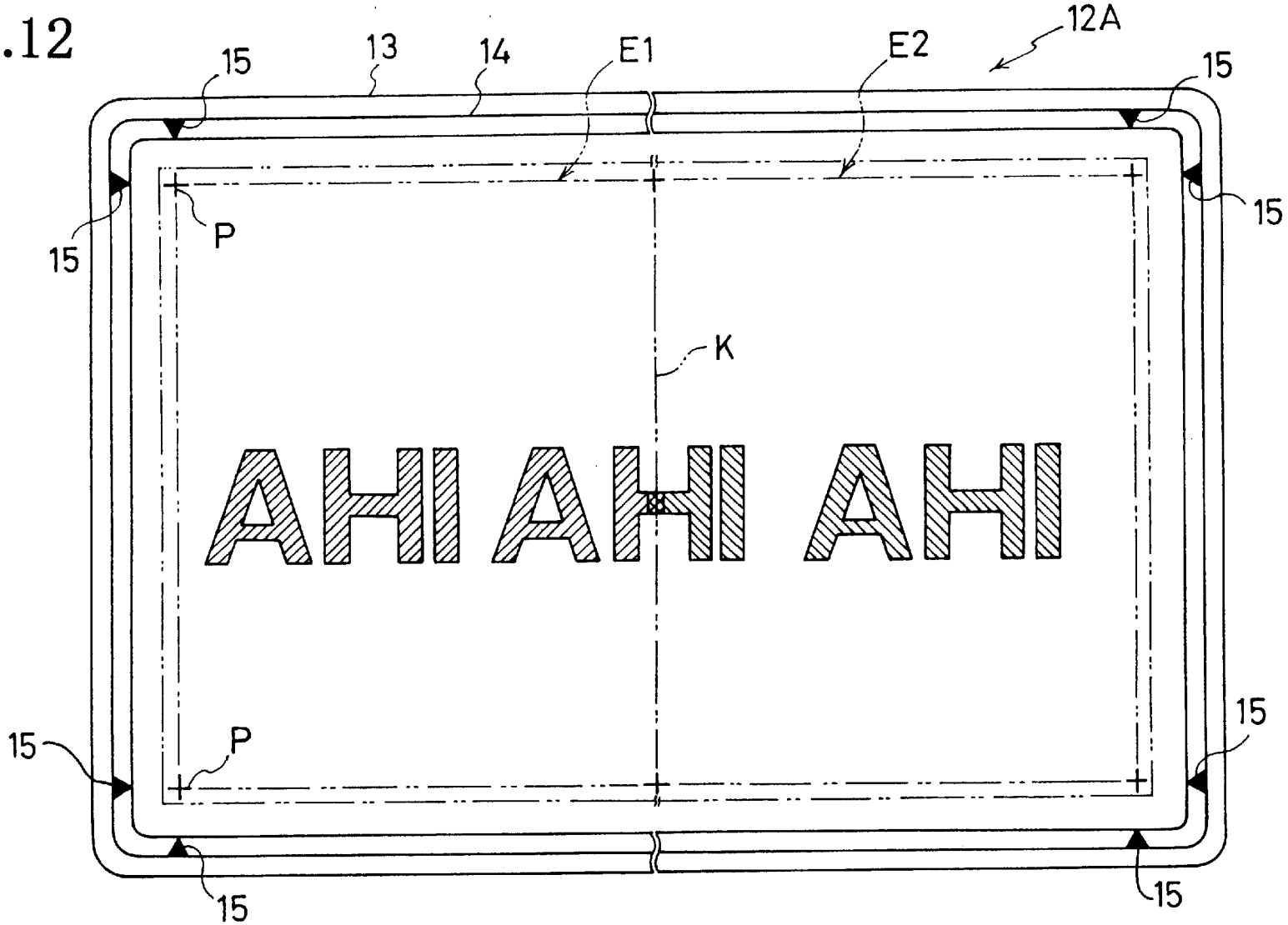
FIG. 12 is an explanatory view for explaining sewing operation of divided embroidery patterns at a first and a second time.

For example, when the selected letter patterns "AHI AHI AHI" are divided in two, as shown by FIG. 12, a left half of the cloth is set to the large frame 12A and an initial embroidery region E1 is sewn.

In this case, in respect of the final letter pattern "H" of a former half of the divided embroidery frame patterns "AHI AH", as has been explained in reference to FIG. 9(A), the letter pattern is sewn by being extended from the boundary line K to the right side by the predetermined small width A. The reference marks P are then respectively sewn at four corner portions of the embroidery region E1. Further, when the cloth is restretched, the cloth is set to the large frame 12A such that the four reference marks P inscribed in the initial sewing operation are made to respectively coincide with the frame side reference marks 15 inscribed at the four corners of the embroidery region E2 at the second operation. Thereby, restretching of the cloth is simplified. Further, by carrying out the second sewing operation by operating the start/stop switch 7, a later half of the division embroidery frame pattern "HI AHI" can be sewn continuously to the former half portion.

In this case, the pattern selector is constituted in particular by steps S20 through S22 and S28 of the embroidery pattern selection processing control, the control device 20 and so on. The determiner is constituted in particular by S24 of the embroidery pattern selection processing control, S46 of the pattern arrangement processing control, the control device 20 and the like. The pattern divider is constituted in particular by steps S25 through S27 of the embroidery pattern selection processing control, steps S47 through S49 of the pattern arrangement processing control, the control device 20 and the like. Further, the data adder is constituted in particular by step S27 of embroidery pattern selection processing control, step S49 of the pattern arrangement processing control, the control device 20 and the like.

As has been explained, a single embroidery pattern or a plurality of embroidery patterns for sewing can summarizingly and selectively be set in one motion without being restricted by the size of the embroidery region E and operational performance of pattern selection can be improved. Further, when a selected embroidery pattern for sewing is projected from the embroidery region E of the embroidery frame 12 and an embroidery pattern intersecting with the boundary line K between a first embroidery region E and a second embroidery region E is present, the embroidery data for the respective embroidery regions and overlap data are formed such that the intersecting embroidery pattern is enlarged by the predetermined width A including the boundary line K. Also, the mark data of the reference marks P is formed at the corner portions of the embroidery regions E in correspondence with the longitudinal direction reference position and the lateral direction reference position. Accordingly, the division embroidery frame patterns and the reference marks P are simultaneously sewn, when the cloth is restretched in carrying out embroidery sewing at the second operation or later, by only restretching the cloth for fabrication such that the reference marks P coincide with the frame side reference marks 15 inscribed on the inner frame 14. As a result, the division embroidery patterns can be sewn beautifully and continuously and efficient formation of the sewing operation can be achieved.

Next, an explanation will be given of modified embodiments of the above-described embodiments.

(1) The division embroidery patterns may be sewn by omitting the frame side reference marks 15 on the inner frame 14 of the embroidery frame 12, falling the sewing needle 6 at respective sewn reference marks P when the cloth is restretched for sewing the embroidery regions at the second operation or later. In this case, an arrangement position of the embroidery region E is determined, based on the arrangement of the embroidery region E. In this case, even in the case where a shift is caused in mounting the cloth to the embroidery frame 12, the division embroidery frame pattern can be sewn with excellent positional accuracy.

(2) The reference mark P may be constituted by various symbols, for example, a triangular shape directed to a direction in correspondence with the frame side reference mark 15.

(3) The sewing control in respect of the above-described embodiments show only examples and can be implemented with various modifications within a range not deviated from the technical thought of the present invention.

(4) The present invention is naturally applicable to various sewing apparatuses for sewing various embroidery patterns using an embroidery frame.

While the invention has been described in conjunction with the specific embodiments described above, it is evident that many alternatives, modifications and variations will be apparent to those skilled in the art. Accordingly, the embodiments of the invention as set forth above are intended to be illustrative and not limiting. Various changes may be made without departing from the spirit and scope of the invention as defined herein.

What is claimed is:

1. A sewing apparatus for sewing at least one embroidery pattern on a cloth by driving to independently move an embroidery frame set with the cloth in two directions orthogonal to each other, said sewing apparatus comprising:

a pattern selector that selectively sets the at least one embroidery pattern for an embroidery operation;

a determiner that determines whether the at least one selectively set embroidery pattern projects from an embroidery region of the embroidery frame and intersects with a boundary line between the embroidery region and an embroidery region contiguous thereto based on information of arrangements and sizes of the at least one embroidery pattern selectively set by the pattern selector and information of a size of the embroidery frame; and a pattern divider for receiving pattern data of an embroidery pattern selected by the pattern selector, dividing the embroidery pattern intersecting with the boundary line and forming pattern data for respective divided embroidery regions when the determiner determines that the embroidery pattern intersects with the boundary.

2. The sewing apparatus according to claim 1, wherein the embroidery regions are set as regions inside of an outer peripheral line of a sewable region in the embroidery frame by predetermined small distances, and wherein the pattern divider divides the embroidery pattern when the embroidery pattern is divided such that a first portion of the divided embroidery pattern on one side of the boundary and a second portion of the divided embroidery pattern on other side of the boundary overlap by a predetermined width including the boundary line.

3. The sewing apparatus according to claim 1, wherein the pattern divider includes a data adder that adds mark data for sewing a plurality of reference marks constituting a longitudinal direction reference and a lateral direction reference as marks in restretching the cloth to the embroidery frame.

4. The sewing apparatus according to claim 1, further comprising:

a display; and a display controller that controls the display, wherein a necessary size of the cloth is displayed on the display based on the information of the arrangement and the size of the selected embroidery pattern, the information of the size of the embroidery frame and a number of the boundary lines dividing the at least one embroidery pattern.

5. The sewing apparatus according to claim 4, wherein when the selected embroidery pattern is present over a plurality of the embroidery regions, the embroidery pattern, the plurality of embroidery regions and the boundary lines are displayed on the display.

6. The sewing apparatus according to claim 1, further comprising:

an embroidery frame determiner that selectively uses a plurality of embroidery frames having different sizes to determine which of the plurality of embroidery frames is suitable for use as the embroidery frame based on the pattern data of the at least one embroidery pattern selectively set by the pattern selector.

7. The sewing apparatus according to claim 3, wherein frame side reference marks in correspondence with the plurality of reference marks are inscribed on the embroidery frame.

8. A method of dividing an embroidery pattern sewn on a workpiece, the workpiece being held in a frame, the method comprising:

selecting the embroidery pattern from a plurality of embroidery patterns;

utilizing a control device to determine whether the embroidery pattern projects from an embroidery region of the frame and intersects a boundary of the embroidery region of the frame;

dividing the embroidery pattern into a plurality of embroidery portions including at least a first embroidery portion and a second embroidery portion when it is determined that the embroidery pattern intersects the boundary of the embroidery region of the frame.

9. The method according to claim 8, wherein the boundary of the embroidery region is set inside a boundary of a sewable region of the frame by a first distance and the embroidery pattern is divided such that the first embroidery portion and the second embroidery portion overlap by a second distance.

10. The method according to claim 8, further comprising adding mark data for sewing a plurality of longitudinal reference marks and a plurality of lateral reference marks for use in restretching the workpiece to the frame.

11. The method according to claim 8, further comprising displaying a size of the workpiece required to sew the embroidery pattern, a size of the frame to be used and a number of embroidery portions into which the embroidery pattern is divided.

12. The method according to claim 11, wherein the embroidery pattern, the plurality of embroidery portions and the boundary lines are displayed on the display.

13. The method according to claim 8, further comprising determining which of a plurality of different size embroidery frames is to be used as the frame.

14. The method according to claim 10, wherein frame side reference marks in correspondence with the plurality of longitudinal reference marks and the plurality of lateral reference marks are inscribed on the frame.

15. A recording medium that stores a control program for dividing an embroidery pattern sewn on a workpiece, the workpiece being held in a frame, the control program including instructions for:

selecting the embroidery pattern from a plurality of embroidery patterns;

determining whether the embroidery pattern projects from an embroidery region of the frame and intersects a boundary of the embroidery region of the frame;

dividing the embroidery pattern into a plurality of embroidery portions including at least a first embroidery portion and a second embroidery portion when it is determined that the embroidery pattern intersects the boundary of the embroidery region of the frame.

16. The recording medium according to claim 15, wherein the boundary of the embroidery region is set inside a boundary of a sewable region of the frame by a first distance and the embroidery pattern is divided such that the first embroidery portion and the second embroidery portion overlap by a second distance.

17. The recording medium according to claim 15, further including instructions for adding mark data for sewing a plurality of longitudinal reference marks and a plurality of lateral reference marks for use in restretching the workpiece to the frame.

18. The recording medium according to claim 15, further including instructions for displaying a size of the workpiece required to sew the embroidery pattern, a size of the frame to be used and a number of embroidery portions into which the embroidery pattern is divided.

19. The recording medium according to claim 18, wherein the embroidery pattern, the plurality of embroidery portions and the boundary lines are displayed on the display.

20. The recording medium according to claim 15, further including instructions for determining which of a plurality of different size embroidery frames is to be used as the frame.

21. The recording medium according to claim 17, wherein frame side reference marks in correspondence with the plurality of longitudinal reference marks and the plurality of lateral reference marks are inscribed on the frame.

* * * * *